US007786339B2

(12) United States Patent
Lin et al.

(10) Patent No.: US 7,786,339 B2
(45) Date of Patent: Aug. 31, 2010

(54) METHOD OF REMOVING ORGANIC CONTAMINANTS FROM SURFACES OF SOLID WASTES

(75) Inventors: Yu-Ming Lin, Hsinchu County (TW); Lik-Hang Chau, Tainan (TW); Da-Hai Lin, Tainan County (TW); Chun-Ting Tung, Tainan County (TW)

(73) Assignees: Industrial Technology Research Institute, Hsinchu (TW); Chang International Enterprise Co., Ltd., Tainan (TW)

( * ) Notice: Subject to any disclaimer, the term of this patent is extended or adjusted under 35 U.S.C. 154(b) by 424 days.

(21) Appl. No.: 11/882,720

(22) Filed: Aug. 3, 2007

(65) Prior Publication Data

US 2008/0161630 A1 Jul. 3, 2008

(30) Foreign Application Priority Data

Dec. 28, 2006 (TW) ..... 95149460 A

(51) Int. Cl.
*A62D 3/00* (2007.01)

(52) U.S. Cl. ..... 588/405; 588/400

(58) Field of Classification Search ..... 588/405, 588/400
See application file for complete search history.

(56) References Cited

U.S. PATENT DOCUMENTS

| | | | | |
|---|---|---|---|---|
| 4,861,484 | A | 8/1989 | Lichtin et al. | |
| 5,294,315 | A | 3/1994 | Cooper et al. | |
| 6,585,863 | B2 * | 7/2003 | Davydov et al. | 204/157.3 |

FOREIGN PATENT DOCUMENTS

| | | | |
|---|---|---|---|
| TW | 200505574 | A | 2/2005 |

* cited by examiner

*Primary Examiner*—Timothy C Vanoy
*Assistant Examiner*—Michelle Hou
(74) *Attorney, Agent, or Firm*—Birch, Stewart, Kolasch & Birch, LLP

(57) ABSTRACT

A method of removing organic contaminants from surfaces of solid wastes is disclosed. The method includes the steps of forming a $TiO_2$ sol; mixing the solid wastes and the $TiO_2$ sol by stirring. Furthermore, the mixture undergoes photo-catalytic remediation under illumination of a UV source prior to a solid-liquid separation process of the illuminated $TiO_2$ sol and solid wastes.

14 Claims, 2 Drawing Sheets

METHOD OF REMOVING ORGANIC CONTAMINANTS FROM SURFACES OF SOLID WASTES

BACKGROUND OF THE INVENTION

1. Field of the Invention

The present invention relates to a method of removing organic contaminants from surfaces of solid wastes.

2. Description of the Related Art

Various methods regarding to decomposition of organic contaminants (e.g. dioxins) have been proposed.

In U.S. Pat. No. 6,585,863, a method of treating a contaminated aqueous liquid or gaseous fluid containing organics using a combination of visible or solar light energy in the presence of a photocatalyst to decompose the organic impurities in the liquid or gaseous fluid is disclosed.

In U.S. Pat. No. 5,294,315, a method of decontaminating a contaminated fluid by using photocatalystic particles is disclosed.

In U.S. Pat. No. 4,861,484, a catalytic process for degradation of organic materials in aqueous and organic fluids to produce environmentally compatible products is disclosed.

However, methods for treatment of dioxins-contaminated solid wastes using photocatalyst have not been proposed. In addition, the conventional methods are mostly operated at very high temperature, thus not only increasing the treatment cost but leading to complexity of treatments because dioxins might occur again during the subsequent processes.

Accordingly, a method of removing organic contaminants from surfaces of solid wastes is desirable.

BRIEF SUMMARY OF THE INVENTION

In view of the described problems, an embodiment of a method of removing organic contaminants from surfaces of solid wastes is disclosed. The method includes the steps of forming a $TiO_2$ sol; mixing the solid wastes and the $TiO_2$ sol by stirring. Furthermore, the mixture undergoes photo-catalytic remediation under illumination of a UV source prior to a solid-liquid separation process of the illuminated $TiO_2$ sol and solid wastes.

According to the embodiment above, an ultraviolet (UV) source is used to degrade the organic contaminants (e.g. trace dioxins) on surfaces of solid wastes (e.g. soil or fly ash) via the photocatalyst serving as a medium. Specifically, the nano-scale $TiO_2$ sol serving as a photocatalyst is used as a main reagent, and is well mixed with the solid wastes. The mixture is continuously stirred to have nano-scale $TiO_2$ particles sufficiently contact the organic contaminants on surfaces of solid wastes. Subsequently, the mixture undergoes photo-catalytic remediation under illumination of a UV source, leading to degradation of the organic contaminants. Finally, the contaminants can be removed from surfaces of solid wastes.

A detailed description is given in the following embodiments with reference to the accompanying drawings.

BRIEF DESCRIPTION OF THE DRAWINGS

The present invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

First Embodiment

Figure 1:
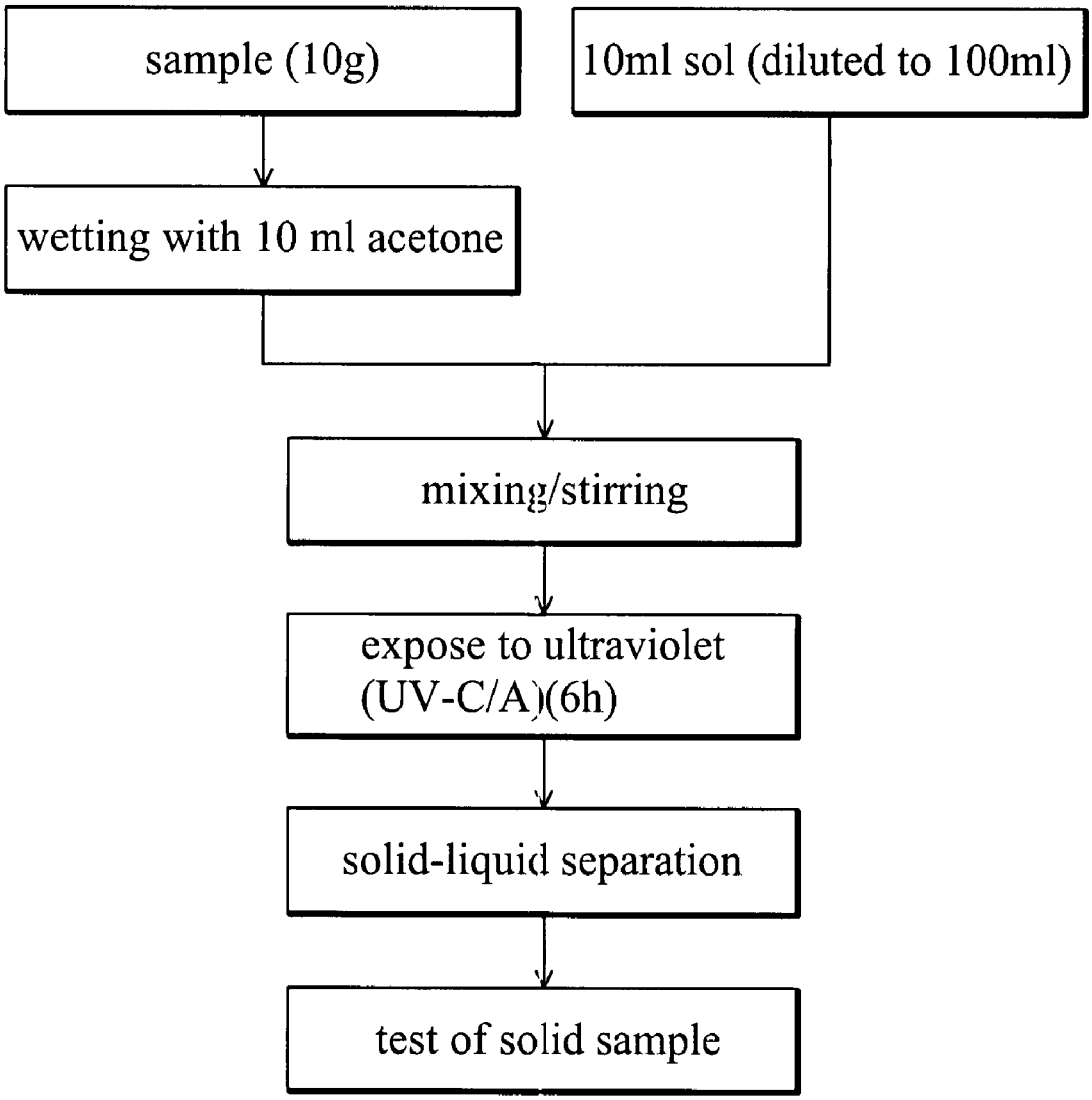
FIG. 1 is a schematic view showing a flowchart of an embodiment of liquid-phase suspension (solution) treatment using a photocatalytic sol.

FIG. 1 is a schematic view showing a flowchart of an embodiment of liquid-phase suspension treatment using a photocatalytic sol. This embodiment employs the method shown in FIG. 1.

As to the method shown in FIG. 1, for example, it can be operated at an operation temperature between 5-50° C. First, the sample such as 10 g solid ash is wetted using 10 ml acetone, and is then mixed with excess photocatalytic sol such as 100 ml dilution solution by stirring, thus a liquid-phase suspension is formed. In the liquid-phase suspension, the ratio of the excess sol to ash stands at 9:1 by weight. The stirring may be mechanical stirring or stirring by an ultrasonic sieving. Subsequently, the liquid-phase suspension is continuously stirred under illumination of a UV-C source for at least six hours, letting the ash particles to be sufficiently exposed to a UV-C source. The treated ash and the excess photocatalytic sol are separated, and the solid sample is then dried. A test is performed on the dried sample to measure the content of dioxins therein. The remaining photocatalytic sol can be recycled by adding fresh photocatalytic sol, thus not only reducing cost of materials but also avoiding water pollution. The content of $TiO_2$ in the photocatalytic sol can be adjusted appropriately between 0.01% and 0.1% by weight. In doing so, the content of $TiO_2$ in the photocatalytic sol can be maintained at an optimal value, and cost of the photocatalytic sol can be reduced, while still having the same or higher photocatalytic degradation efficiency of dioxins. In this embodiment, the $TiO_2$ sol is neutral liquid-phase solution, and the $TiO_2$ therein is an anatase crystalline structure. The particles in the $TiO_2$ sol have a diameter less than 100 nm, preferably, less than 30 nm.

Table 1 shows that dioxins-containing samples were subjected to a liquid-phase suspension treatment using a photocatalytic sol. As shown in Table 1, the sample A (ash) and the sample B (soil) subjected to liquid-phase suspension treatment and illumination of a UV source (e.g. UV-C or UV-A) have lower concentration (represented by ng-TEQ/g) of dioxins. Specifically, the dioxins-containing concentration of the samples subjected to illumination of UV-C is apparently reduced.

TABLE 1

| | Concentration (ng-TEQ/g) | | | Concentration (ng-TEQ/g) | |
|---|---|---|---|---|---|
| Sample A (initial concentration) | 5.84 | | Sample B (initial concentration) | 72.4 | |
| After liquid-phase suspension treatment | 2.13[a] | 5.58[b] | After liquid-phase suspension treatment | 31.7[a] | 43.5[b] |

Figure 2:
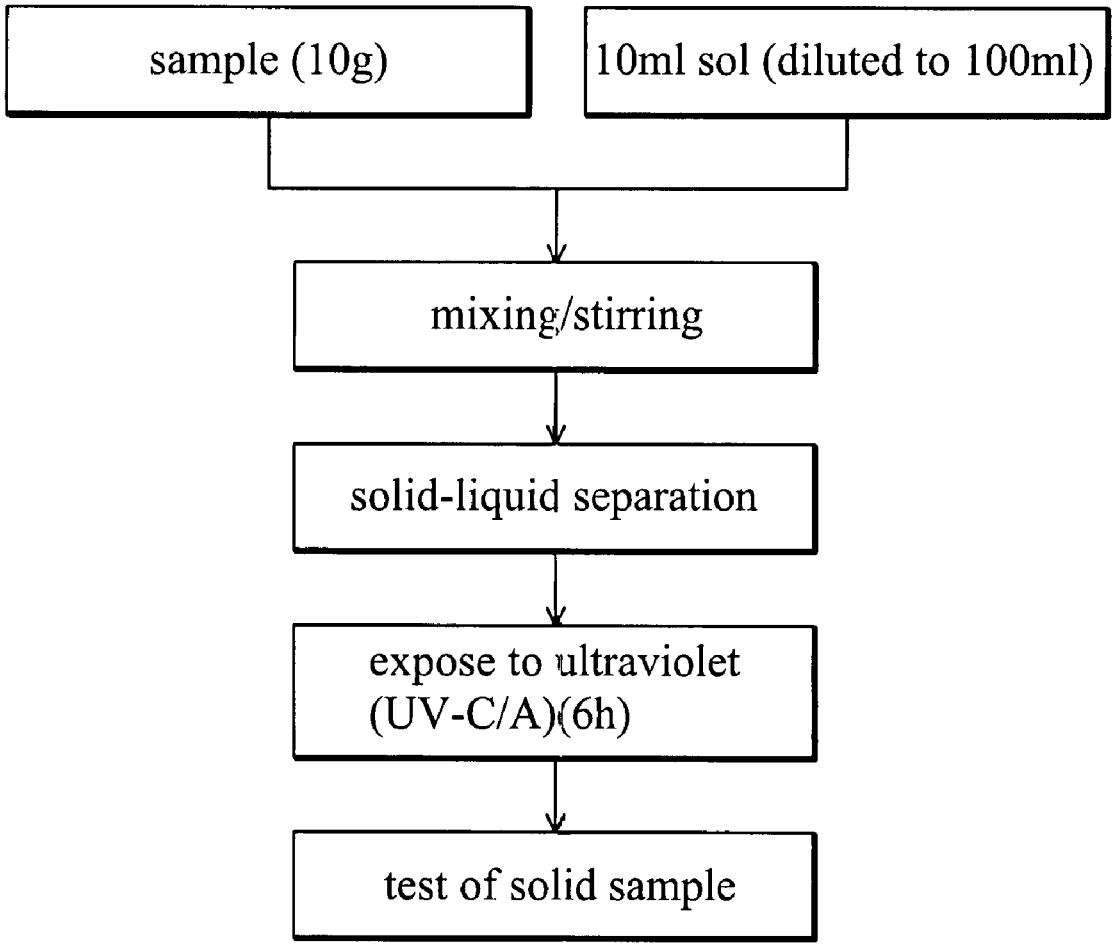
FIG. 2 is a schematic view showing a flowchart of an embodiment of another treatment using a photocatalytic sol.

[a]under illumination of UV-C; light intensity >1 mW/cm$^2$
[b]under illumination of UV-A; light intensity >1 mW/cm$^2$ Second Embodiment FIG. 2 is a schematic view showing a flowchart of an embodiment of another treatment using a photocatalytic sol. This embodiment employs the method shown in FIG. 2.

As to the method shown in FIG. 2, for example, it can be operated at an operation temperature between 5-50° C. First, the sample such as 10 g solid ash is mixed with excess photocatalytic sol such as 100 ml dilution solution by stirring. The stirring may be mechanical stirring or stirring by an ultrasonic sieving. Next, a solid-phase separation process is performed, thus a solid sample is obtained from the mixture. The solid sample is then spread on a sheet to be illuminated by UV-C for at least six hours. To make the solid sample sufficiently illuminated by UV-C, it is stirred every half an hour or an hour. The treated ash is directly subjected to measurement of the content of dioxins without separation of photocatalytic particles. In this embodiment, the $TiO_2$ sol is neutral liquid-phase solution, and the $TiO_2$ therein is an anatase crystalline structure. The particles in the $TiO_2$ sol have a diameter less than 100 nm, preferably, less than 30 nm.

Table 2 shows that dioxins-containing samples were subjected to the treatment shown in FIG. 2 using a photocatalytic sol. As shown in Table 2, the sample A (ash) and the sample B (soil) subjected to the treatment shown in FIG. 2 and illumination of UV-C have relatively lower concentration (represented by ng-TEQ/g) of dioxins.

TABLE 2

| | Concentration (ng-TEQ/g) | | Concentration (ng-TEQ/g) |
|---|---|---|---|
| Sample A (initial concentration) | 5.84 | Sample B (initial concentration) | 72.4 |
| After treatment | 3.00[a] | After treatment | 26.1[a] |

[a]under illumination of UV-C; light intensity >1 mW/cm$^2$

According to methods of theses embodiments, nano-scale $TiO_2$ sol serving as photocatalyst is employed to degrade dioxins on surfaces of the soil or ash. That is, by means of mixing and stirring the solid wastes and the $TiO_2$ sol, and performing illumination of a UV source, the dioxins on surfaces of the solid wastes can be decomposed. Compared to the conventional treatments, there is no need to undergo high temperature treatments and to use curing agents. Alternatively, the methods of theses embodiments can be employed to decompose other organic contaminants on surfaces of the solid wastes at room temperature.

While the invention has been described by way of example and in terms of the preferred embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A method of removing organic contaminants from surfaces of solid wastes, comprising:

forming a $TiO_2$ sol;

mixing the solid wastes and the $TiO_2$ sol by stirring;

having the mixture undergo photo-catalytic remediation under illumination of a UV source;

performing a solid-liquid separation process of the illuminated $TiO_2$ sol and solid wastes.

2. The method as claimed in claim 1, wherein the solid wastes comprise fly ash of a steelmaking, fly ash of a combustor, contaminated soil, or contaminated slurry.

3. The method as claimed in claim 1, wherein the organic contaminants comprise dioxins or hydrocarbon compounds.

4. The method as claimed in claim 1, wherein the UV source comprises UV-C or UV-A.

5. The method as claimed in claim 1, wherein the UV source has a light intensity between 0.5~50 mW/cm$^2$.

6. The method as claimed in claim 1, wherein the illumination of the UV source takes 2~100 hours.

7. The method as claimed in claim 1, further comprising:

performing the method at an operation temperature between 5-5°.

8. The method as claimed in claim 1, further comprising:

addition of a wetting agent, making the surfaces of solid wastes more hydrophilic, thus facilitating contact between the $TiO_2$ sol and the surfaces of solid wastes;

wherein the wetting agent includes acetone.

9. The method as claimed in claim 8, wherein the ratio of dosage of the $TiO_2$ sol to weight of the solid wastes stands at 2:1 to 20:1.

10. The method as claimed in claim 8, wherein the content of $TiO_2$ in the $TiO_2$ sol is between 0.01% and 10% by weight.

11. The method as claimed in claim 1, wherein the stirring step comprises mechanic stirring or stirring by an ultrasonic sieving.

12. The method as claimed in claim 1, wherein the $TiO_2$ sol is neutral aqueous solution, and wherein the $TiO_2$ therein is an anatase crystalline structure.

13. The method as claimed in claim 12, wherein particles in the $TiO_2$ sol have a diameter less than 100 nm.

14. The method as claimed in claim 12, wherein particles in the $TiO_2$ sol have a diameter less than 30 nm.

* * * * *